US006267464B1

(12) United States Patent
Furlani et al.

(10) Patent No.: US 6,267,464 B1
(45) Date of Patent: Jul. 31, 2001

(54) SELF CLEANING INK JET PRINTHEAD CARTRIDGES

(75) Inventors: Edward P. Furlani, Lancaster; Syamal K. Ghosh; Dilip K. Chatterjee, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/221,349

(22) Filed: Dec. 28, 1998

(51) Int. Cl.[7] ..... B41J 2/165
(52) U.S. Cl. ..... 347/27; 347/22; 347/28
(58) Field of Search ..... 134/1; 347/27–30, 347/22, 24, 104; 366/127; 346/75

(56) References Cited

U.S. PATENT DOCUMENTS

| | | | | |
|---|---|---|---|---|
| 4,500,895 | | 2/1985 | Buck et al. | 347/86 |
| 4,563,688 | | 1/1986 | Braun | 347/27 |
| 4,794,409 | | 12/1988 | Cowger et al. | 347/86 |
| 4,800,403 | * | 1/1989 | Accattino et al. | 347/27 |
| 4,849,769 | * | 7/1989 | Dressler | 347/27 |
| 4,849,774 | | 7/1989 | Endo et al. | 417/207 |
| 5,103,244 | | 4/1992 | Gast et al. | 347/33 |
| 5,248,998 | | 9/1993 | Ochiai et al. | 347/68 |
| 5,287,126 | * | 2/1994 | Quate | 347/27 |
| 5,300,958 | | 4/1994 | Burke et al. | 347/33 |
| 5,311,218 | | 5/1994 | Ochiai et al. | 347/68 |
| 5,543,827 | * | 8/1996 | VanSteenkiste et al. | 347/27 |
| 5,574,485 | * | 11/1996 | Anderson et al. | 347/27 |
| 5,598,196 | | 1/1997 | Braun | 347/68 |
| 5,682,191 | * | 10/1997 | Barrett et al. | 347/104 |
| 5,757,396 | * | 5/1998 | Bruner | 347/27 |
| 5,877,788 | * | 3/1999 | Haan et al. | 347/28 |
| 5,929,877 | * | 7/1999 | Hetzer et al. | 347/28 |

FOREIGN PATENT DOCUMENTS

| | | | |
|---|---|---|---|
| 0585615 | 7/1993 | (EP) | B41J/2/175 |
| 2280149 | 1/1995 | (GB) | B41J/2/165 |
| 56-106868 | 8/1981 | (JP) | B41J/3/04 |
| 58-096563 | 8/1983 | (JP) | B41J/3/04 |
| 61-1938857 | 8/1986 | (JP) | B41J/3/04 |
| 4039055 | 10/1992 | (JP) | B41J/2/165 |

* cited by examiner

*Primary Examiner*—N. Le
*Assistant Examiner*—Anh T. N. Vo
(74) *Attorney, Agent, or Firm*—Raymond L. Owens

(57) ABSTRACT

Ink jet cartridge for an ink jet printer including an orifice plate having a plurality of orifices for ink ejection; a cartridge for receiving a reservoir having ink which is adapted to be ejected through the orifices, the cartridge including a cleaning manifold having a plurality of inlet and outlet passages through which cleaning fluid can be applied so that such fluid is directed across the surface of the orifice plate; and a plurality of actuable ultrasonic transducers disposed in operative relationship with respect to the orifice plate and which when actuated produce ultrasonic sound waves which impinge upon the orifice plate to loosen debris whereby the cleaning fluid directed across the surface of the orifice plate carries away such loosened debris.

5 Claims, 3 Drawing Sheets

SELF CLEANING INK JET PRINTHEAD CARTRIDGES

CROSS REFERENCE TO RELATED APPLICATIONS

Reference is made to commonly assigned U.S. patent applications Ser. No. 09/127,546 filed Jul. 31, 1998, by Ghosh et al, entitled "Non-Contact Ultrasonic Cleaning of Ink Jet Printhead Cartridges"; U.S. patent application Ser. No. 09/159,725 filed Sep. 24, 1998, by Ghosh et al, entitled "Ultrasonic Cleaning of Ink Jet Printhead Cartridges"; U.S. patent application Ser. No. 09/132,628 filed Aug. 11, 1998, by Ghosh et al, entitled "Vacuum Assisted Ultrasonic Cleaning of Ink Jet Printhead Cartridges"; and U.S. patent application Ser. No. 09/179,498 filed Oct. 27, 1998, by Ghosh et al, entitled "High Frequency Ultrasonic Cleaning of Ink Jet Printhead Cartridges", the teachings of which are incorporated herein by reference.

FIELD OF THE INVENTION

This invention relates to an ink jet printer and more particularly to improved cleaning system for self cleaning ink jet printhead cartridges.

BACKGROUND OF THE INVENTION

Typically, an ink jet printer has at least one printing cartridge from which droplets of ink are directed towards a receiver. Within the cartridge, the ink may be contained in a plurality of channels and energy pulses are used to cause the droplets of ink to be ejected on demand or continuously, from nozzles or orifices in a plate in an orifice structure.

In a thermal ink jet printer, the energy pulses are generally provided by a set of electrical resistors, each located in a respective one of the channels, each one of them is individually addressable by current pulses to instantaneously heat and form a droplet or bubble in the channels which contact the resistors. Operation of thermal ink jet printer is described in details in U.S. Pat. Nos. 4,849,774; 4,500,895; and 4,794,409.

On the other hand, a piezoelectric ink jet printing system includes a body of piezoelectric material defining a plurality of parallel open topped channels separated by walls. The walls have metal electrodes on opposite sides thereof to form shear mode actuators for causing droplets to expel from the channels. An orifice structure comprising at least one orifice plate defining the holes through which the ink droplets are ejected is bonded to the open end of the channels. The electrical energy pulses are applied to the parallel electrodes causing the channels to shear actuating the expulsion of droplets from the orifice plate. Operation of piezoelectric ink jet print heads is described in details in U.S. Pat. Nos. 5,598,196; 5,311,218; and 5,248,998.

Ink jet printing cartridges, whether it is of thermal or piezoelectric kind, use a variety of functional components, all of which must cooperate in a precise manner to achieve maximum efficiency. One of the most important components is an orifice plate having a plurality of orifices or nozzles therein. The nozzles are usually circular in cross section and the diameter of the nozzles may vary from 10 to 100 $\mu$m as required by the specification of the printer. Higher the resolution of the printed output, smaller is the ink droplet thereby requiring smaller diameter nozzles or orifices. Ink is ejected through these openings during printing operation. To obtain defect-free printing output, the orifice plates and all the nozzles must be kept clean and free of debris and any kind of obstructions to ink flow at all times. If the orifice plate and nozzles are not clean, many problems can occur thereby undermining the performance of the printer. As for example, paper fibers and other debris accumulated on the orifice plate surface and inside the nozzles can affect the quality of the printed images. Similarly, debris can be dried ink crust and paper dust on the orifice plate as well as in the ink channels and the nozzles can cause the printer to perform poorly.

The foregoing problems are overcome, as described in U.S. Pat. No. 5,300,958 to Burke et al, by providing "maintenance or service stations" within the main printer unit. The maintenance stations are designed such that when the printhead ink cartridge is not operating and is in a "parked" position, the cartridge is situated in the maintenance station outside the printing zone for the purpose of routine cleaning of the cartridges. The maintenance station has many components, which are designed to serve many functions. These functions include: (a) priming the printhead cartridge, (b) capping the orifice plate and nozzles (orifices) therein when the printhead is not in operation, (c) wiping contaminants from the orifice plate, (d) preventing ink from drying out in the openings of the orifice plate, and (e) providing a receptacle for discarding the cleaned debris.

To accomplish this cleaning, the U.S. Pat. No. 5,103,244 discloses a structure in which a multi-blade wiper is used. The desired cleaning is performed by dragging a printhead (cartridge) across the selected wiper blade. The wiper mechanism also includes a plurality of resilient blades each having an octagonal shape and rotatable about an axis.

Another cleaning structure disclosed in U.S. Pat. No. 5,300,958, includes a printhead wiper unit consisting of a single or dual members positioned against each other to form a capillary pathway therebetween. The cartridge includes a compartment having an opening therethrough and an absorbent member impregnated with cleaning solution.

Still another cleaning structure is disclosed in U.S. Pat. No. 5,574,485 which includes use of a high frequency ultrasonic liquid wiper wherein a cleaning nozzle is confrontingly aligned but spaced from printhead nozzles. A cleaning solution is held within the cleaning nozzle by surface tension to form a meniscus and is caused to bulge toward into contact with the printhead nozzle face and form a bridge of cleaning solution therewith. In addition to dissolving ink the cleaning solution is ultrasonically excited by a piezoelectric material immediately upstream of the cleaning nozzle to provide a high frequency energized liquid wiper to facilitate cleaning of clogged nozzles without having physical contact with the printhead nozzle face.

SUMMARY OF THE INVENTION

It is an object of the present invention to provide improved cleaning of ink jet printhead cartridges.

It is another object of the present invention to provide a more efficient printhead cartridge cleaning system which permits a controlled dislodging of debris accumulated in the orifices of the orifice structure, discarding the debris without contaminating and damaging the cartridges and thereby cleaning the printhead cartridges efficiently.

It is another object of the present invention to provide an apparatus for cleaning an ink jet printhead cartridge, which is compact, robust and efficient.

It is yet another object of the present invention to provide a cleaning apparatus, which does not abrade or damage the ink jet cartridges.

These objects are achieved in an ink jet cartridge for an ink jet printer comprising:

(a) an orifice plate having a plurality of orifices for ink ejection;

(b) a cartridge for receiving a reservoir having ink which is adapted to be ejected through the orifices, the cartridge including a cleaning manifold having a plurality of inlet and outlet passages through which cleaning fluid can be applied so that such fluid is directed across the surface of the orifice plate; and (c) a plurality of actuable ultrasonic transducers disposed in operative relationship with respect to the orifice plate and which when actuated produce ultrasonic sound waves which impinge upon the orifice plate to loosen debris whereby the cleaning fluid directed across the surface of the orifice plate carries away such loosened debris.

Advantages of the invention include:

Overcoming many of the disadvantages of the existing technology, such as damage of the orifice plates due to wear, abrasion and distortion;

Providing a manifold structure in the cartridge itself which permits an effective way of providing cleaning fluid to clean the orifice plate;

Embedding actuable ultrasonic transducers in the orifice plate to provide an effective way of cleaning the orifice plate;

Cost-effective electronic integration of the high frequency actuable high frequency ultrasonic transducer to clean ink jet printhead cartridge; and Use of solvents and other undesirable chemicals can be avoided.

DETAILED DESCRIPTION OF THE PREFERRED EMBODIMENT

The present invention provides an apparatus for cleaning an ink jet printhead cartridge which uses at least one actuable ultrasonic transducer embedded in an orifice plate of an ink jet cartridge. A cap is brought in contact with the orifice plate rendering an air tight seal with orifice plate, and a stream of cleaning fluid is pumped over the orifice plate while energizing the embedded actuable ultrasonic transducers.

The construction and the use of a typical ultrasonic cleaner has been described in details in a commonly assigned U.S. patent application Ser. No. 09/179,498 filed Oct. 27, 1998 by Ghosh et al, entitled "High Frequency Ultrasonic Cleaning of Ink Jet Printhead Cartridges".

Figure 1:
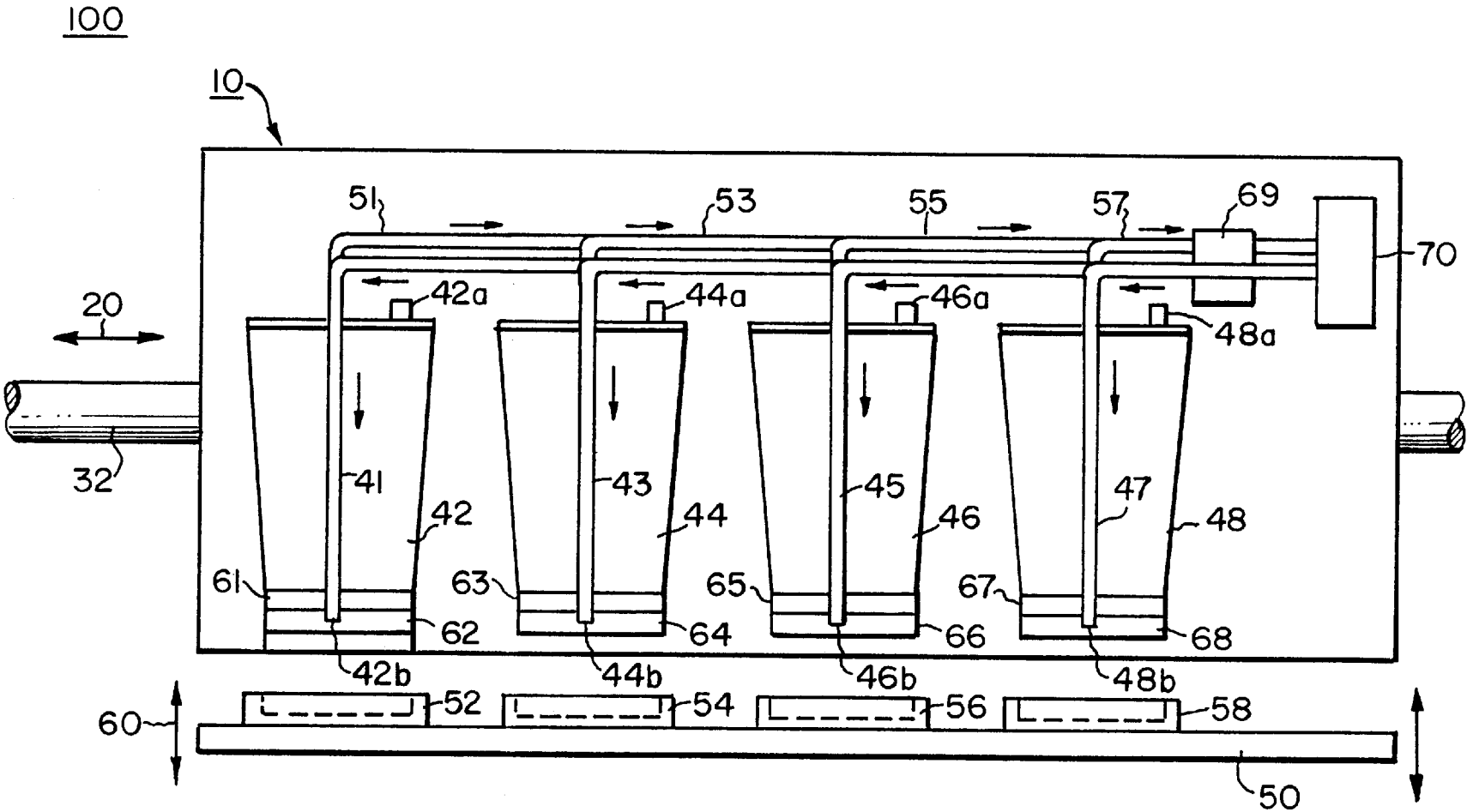
FIG. 1 is an end view of the maintenance station comprising the self cleaning cartridges of the invention.

Referring to FIG. 1, a detailed description of the maintenance station 100 of the present invention will now be provided. The maintenance station 100 incorporates self cleaning ink jet printhead cartridges 42, 44, 46, and 48 which are attached to a printhead carriage 10 which travels back and forth on a carriage rod 32 through the printing zone as shown by a directional arrow 20. Printhead carriage 10 is moved bi-directionally typically by means of a drive belt (not shown) which is connected to a carriage motor (not shown). Caps 52, 54, 56, and 58 are mounted rigidly on a movable platform 50. The platform 50 can be made of metals like aluminum or steel or heavy duty plastics. The platform 50 moves up or down as shown by a directional arrow 60. Four ink jet printhead cartridges 42, 44, 46, and 48 are shown here to describe fully the embodiment of the present invention. For purposes of the illustrative embodiment described in this invention, cartridge 42 utilizes black ink while cartridges 44, 46, and 48 can use only cyan, yellow, and magenta ink, respectively. The cartridges 42, 44, 46, and 48 are each provided with an orifice structure that can define ink channels (see FIG. 2) but will necessarily include orifice structures 62, 64, 66, and 68 through which ink droplets are ejected to a receiver. Furthermore, any number of different colored ink cartridges 42, 44, 46 and 48 could be used, as warranted by the application of the printer. Typically, ink jet cartridges 42, 44, 46, and 48 are preferably piezoelectric ink jet printheads, but other kinds of cartridges, as for example, thermal cartridges may also be acceptable and useful in this invention.

Referring again to FIG. 1, ink jet cartridges 42, 44, 46, and 48 are provided with ink inlets 42*a*, 44*a*, 46*a*, and 48*a* for delivering the black, cyan, magenta and yellow ink to the ink jet cartridges 42, 44, 46, and 48, respectively. Cleaning manifolds 61, 63, 65, and 67 corresponding to the ink jet cartridges 42, 44, 46, and 48, respectively are provided with cleaning fluid inlets 42*b*, 44*b*, 46*b*, and 48*b*, respectively and outlets (not shown) are also provided for circulating cleaning fluid through the orifice plate 40 by means of a pump 70. Cleaning fluid conveyed through inlet tubes 41, 43, 45, and 47, is circulated back to the pump 70 through a filter 69 and by means of outlet tubes 51, 53, 55, and 57 as shown by arrows.

The maintenance station 100 of FIG. 1 will be understood by those skilled in the art to be located in a region outside the printing zone at one end of the bi-directional movement, shown by the arrow 20, of carriage 10. Cleaning is accomplished when the ink jet cartridges 42, 44, 46, 48 as they are moved by the carriage rod 32 until they enter the maintenance station 100 where they engage the caps 52, 54, 56, and 58 and are covered by such caps. Cleaning fluid is then introduced and actuable ultrasonic transducers 71, 73, and 75 are energized, as will be described later.

Figure 2:
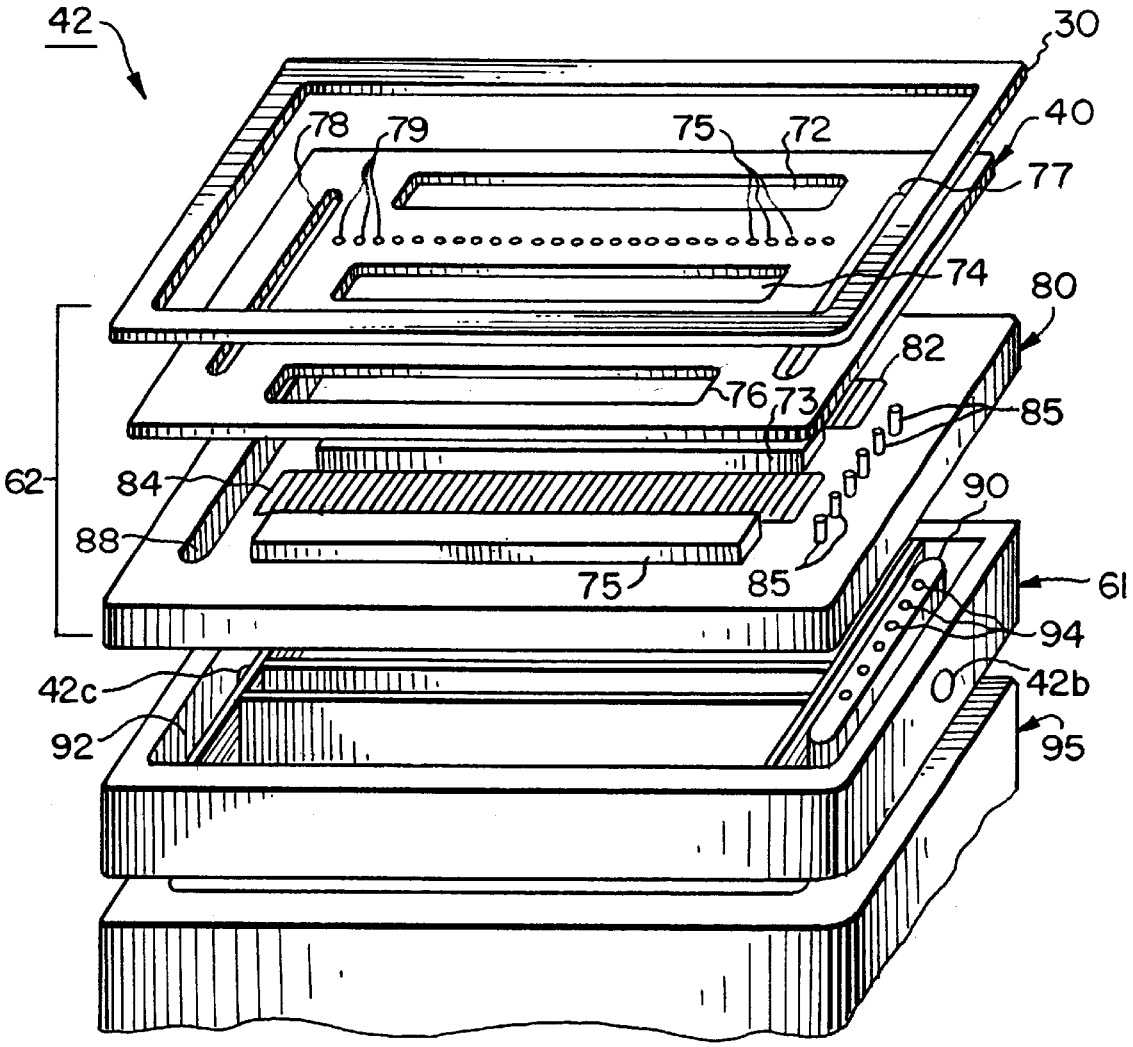
FIG. 2 is an exploded view of a self cleaning printhead cartridge of the invention.

Referring to FIG. 2, an exploded view of the printhead cartridge 42 showing the details of the orifice structure 62 and cleaning manifold 61 along with actuable transducers 71, 73 and 75 which are embedded in the printhead base 80. The printhead cartridge 42 includes several components, which are built individually and assembled together. The orifice structure 62 includes a plastic or rubber gasket 30 which fits around the orifice plate 40, and is bonded to a printhead base 80. The gasket 30 helps sealing the cap 120 (see FIG. 3) against the cartridge 42 so that the cartridge 42 remains water tight during the cleaning process. The orifice plate 40 has several openings including at least one row of closely spaced orifices 79 for ejecting ink drops. The diameter of the orifices 79 may vary from 10 to 100 $\mu$m. The orifice plate 40 may be formed either by electroforming nickel or chemical etching or laser cutting metal sheets, such as aluminum, copper or stainless steel, and the exterior surface is coated with gold to reduce corrosion caused by chemically active species in ink. The openings 72, 74, and 76 in the orifice plate 40 are provided to accommodate the embedded actuable transducers 71, 73, and 75 (see FIG. 3). Similarly, the openings, in the orifice plate 40, designated as inlet channel 77 and outlet channel 78, are provided for channeling the cleaning fluid into and out of the printhead base 80. The printhead base 80 includes ink channels 82 and 84 made from piezoelectric ceramic such as lead-zirconate-titanate, and the actuable ultrasonic transducers 71, 73, and 75 (see FIG. 3). The printhead base 80 is preferably made from alumina ceramic or alternatively from metals like aluminum or stainless steel. A series of inlet tubes 85 are provided for the incoming cleaning fluid to be delivered across the orifice plate 40 for ultrasonic cleaning by energizing the actuable ultrasonic transducers 71, 73, and 75, and an outlet 88 is provide for the cleaning fluid to exit the cleaning manifold 61 through the cleaning fluid outlet 42*c*. A series of tubes 85 for delivering a stream of cleaning fluid across the orifice plate 40 are aligned with holes 94 arranged in the cleaning fluid inlet manifold 90 which lead to cleaning fluid inlet 42*b*. The cleaning fluid exits through first an outlet channel 78 arranged in the orifice plate 40, next through another outlet channel 88 arranged in the printhead base 80, and then finally through an outlet 42*c* which is provided in an outlet gutter 92 being located in the cleaning manifold 61. The tubes 85 protrude through an inlet channel 77 located in the orifice plate 40 and are kept flushed with the top surface of the orifice plate 40. The orifice structure 62 is mounted on the cleaning manifold 61, and those assembled are next bonded on to the ink reservoir 95.

Figure 3:
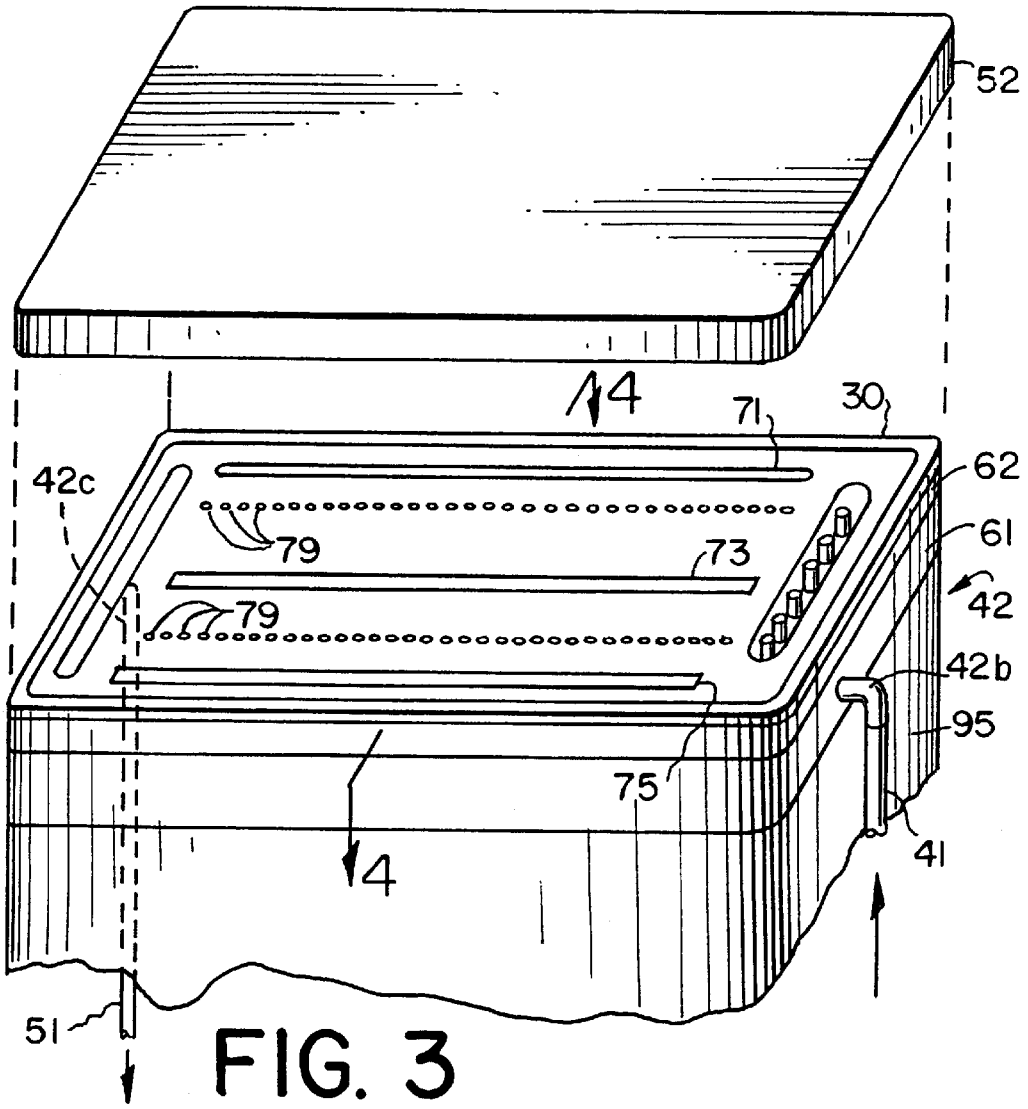
FIG. 3 is a partial isometric view of the assembled self cleaning printhead cartridge of the FIG. 2 showing the cap.

Referring to FIG. 3, a partial view of the ink cartridge 42 in operative relationship with the cap 52 is shown. The cap 52 engages the ink cartridge 42 and makes a watertight seal around the gasket 30. The cleaning fluid is pumped through the inlet tube 41 to the orifice structure 62 and the actuable ultrasonic transducers 71, 73, and 75 are energized for 10 to 30 seconds to effectively clean the clogged orifices 79 and the ink channels 82 and 84 (see FIG. 2).

Figure 4:
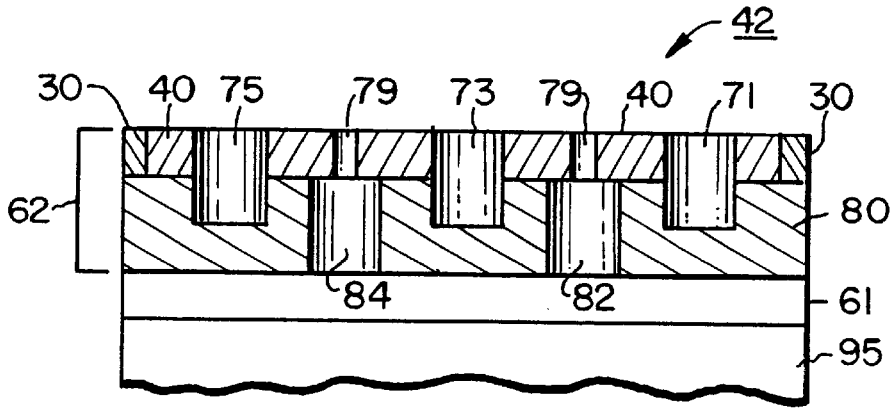
FIG. 4 is a cross sectional view taken along line 4—4 of FIG. 3 showing the details of the orifice structure.

Referring to FIG. 4, a partial cross-sectional view of the ink cartridge 42 along the line 4—4 in FIG. 3 is shown. The actuable ultrasonic transducers 71, 73, and 75 are embedded in the printer base 80 so that their top active surfaces are in the same plane as the top surface of the orifice plate 40. The orifices 79 in the orifice plate 40 are aligned with the open ends of the ink channels 82 and 84 so that ink droplets are ejected from those ink channels as and when each channel is electronically addressed.

In view of the above description, it is understood that modifications and improvements will take place to those skilled in the art which are well within the scope of this invention. The above description is intended to be exemplary only wherein the scope of this invention is defined by the following claims and their equivalents.

PARTS LIST

10 printhead carriage
20 directional arrow
30 gasket
32 carriage rod
40 orifice plate
41 inlet tube
42 black ink cartridge/printhead cartridge
42*a* black ink inlet
42*b* cleaning fluid inlet
42*c* cleaning fluid outlet
43 inlet tube
44 cyan ink cartridge/printhead cartridge
44*a* cyan ink inlet
44*b* cleaning fluid inlet
45 inlet tube
46 magenta ink cartridge/printhead cartridge
46*a* magenta ink inlet
46*b* cleaning fluid inlet
47 inlet tube
48 yellow ink cartridge/printhead cartridge
48*a* yellow ink inlet
48*b* cleaning fluid inlet
50 movable platform
51 outlet tube
52 cap
53 outlet tube
54 cap
55 outlet tube
56 cap
57 outlet tube
58 cap
60 directional arrow
61 cleaning manifold
62 orifice structure
63 cleaning manifold
64 orifice structure
65 cleaning manifold
66 orifice structure
67 cleaning manifold
68 orifice structure
69 filter
70 pump
71 ultrasonic transducer
72 opening for transducer
73 ultrasonic transducer
74 opening for transducer
75 ultrasonic transducer
76 opening for transducer
77 cleaning fluid inlet channel
78 cleaning fluid outlet channel
79 orifice
80 printhead base
81 ink channels
82 ink channels
84 ink channels
85 inlet tubes
88 outlet channel
90 inlet manifold
91 outlet manifold
92 outlet gutter
94 holes
95 ink reservoir
100 maintenance station

What is claimed is:

1. Ink jet cartridge for an ink jet printer comprising:

(a) a printhead including an orifice plate having a plurality of orifices for ink ejection and a base;

(b) a cartridge for receiving a reservoir having ink which is adapted to be ejected through the orifices, the cartridge including a cleaning manifold having a plurality of inlet and outlet passages through which cleaning fluid can be applied so that such fluid is directed across the surface of the orifice plate; and (c) a plurality of actuable ultrasonic transducers embedded in the base and disposed in operative relationship with respect to the orifice plate and which when actuated produce ultrasonic sound waves which impinge upon the orifice plate to loosen debris whereby the cleaning fluid directed across the surface of the orifice plate carries away such loosened debris.

2. In an ink jet printing apparatus for receiving an ink jet cartridge, cleaning means associated with the ink jet cartridge, comprising:

(a) the ink jet cartridge including:

(i) a printhead including an orifice plate having a plurality of orifices for ink ejection and a base;

(ii) an ink reservoir for receiving ink which is adapted to be ejected through the orifices; and (iii) a cleaning manifold connected to the ink reservoir and having a plurality of inlet and outlet passages through which cleaning fluid can be applied across the surface of the orifice plate; and (b) a plurality of actuable ultrasonic transducers embedded in the base and disposed in operative relationship with respect to the orifice plate and which when actuated produce ultrasonic sound waves which impinge upon the orifice plate to loosen debris whereby the cleaning fluid directed across the surface of the orifice plate carries away such loosened debris.

3. The ink jet printing apparatus for receiving an ink jet cartridge of claim 2 further including a cap structure for covering the orifice plate; means for moving the cap structure into a relationship where it covers the orifice plate during cleaning and means for applying cleaning fluid to the inlet passage structure.

4. The ink jet printing apparatus for receiving an ink jet cartridge of claim 2 further including a printer base and wherein actuable ultrasonic transducers are embedded in the printhead base.

5. The ink jet printing apparatus for receiving an ink jet cartridge of claim 4 wherein the embedded actuable ultrasonic transducers have a flat top surface and are in the same plane as the top surface of the orifice plate.

* * * * *